US012043350B1

(12) United States Patent
Dudt

(10) Patent No.: US 12,043,350 B1
(45) Date of Patent: Jul. 23, 2024

(54) IMPLOSION-RESISTANT LIGHTWEIGHT MEMBRANE SHELL DEVICES FOR HIGH-PRESSURE APPLICATIONS

(71) Applicant: The United States of America, as represented by the Secretary of the Navy, Arlington, VA (US)

(72) Inventor: Philip J. Dudt, North Bethesda, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 122 days.

(21) Appl. No.: 17/689,112

(22) Filed: Mar. 8, 2022

Related U.S. Application Data

(60) Provisional application No. 63/167,527, filed on Mar. 29, 2021.

(51) Int. Cl.
*B63B 3/16* (2006.01)
*B63B 22/00* (2006.01)

(52) U.S. Cl.
CPC ..... *B63B 3/16* (2013.01); *B63B 22/00* (2013.01)

(58) Field of Classification Search
CPC .... B63B 3/00; B63B 3/10; B63B 3/13; B63B 3/14; B63B 3/16; B63B 22/00; B63B 22/24
(Continued)

(56) References Cited

U.S. PATENT DOCUMENTS 3,729,756 A * 5/1973 Cook ..... E21B 17/012 405/224.2
4,010,704 A 3/1977 Mayo et al.
(Continued)

FOREIGN PATENT DOCUMENTS

WO WO 2016/128884 A1 8/2016
WO WO 2016/201285 A1 12/2016

OTHER PUBLICATIONS

U.S. Appl. No. 63/167,527, filed Mar. 29, 2021, entitled "Implosion-Resistant Lightweight Membrane Shell Devices For High-Pressure Applications," sole inventor Philip J. Dudt, Navy Case No. 108,103.
(Continued)

*Primary Examiner* — Daniel V Venne
(74) *Attorney, Agent, or Firm* — Howard Kaiser

(57) ABSTRACT

Exemplary practice of the present invention provides a pressure-resistant buoyancy device. An entangled mass of fibers, including shape memory alloy fibers, is positioned inside a three-dimensional enclosure. When inside the enclosure the entangled fibrous mass is attributed with austenitic-phase shape memory, such as by heating. The entangled fibrous mass, thus endowed, exerts an outwardly directed force against the interior wall of the enclosure, thereby structurally reinforcing the buoyancy device and mechanically counteracting an inwardly directed force exerted by ambient fluid upon the buoyancy device, such as by water at greater depths. Exemplary inventive practice affords a buoyancy device that has a light, thin-walled, economical design and yet is highly effective in resisting external pressure. Some inventive embodiments implement an auxetic foam material and/or a fibrous magnetic material, in addition to a fibrous shape memory alloy material.

21 Claims, 3 Drawing Sheets

IV.

(58) Field of Classification Search
USPC ..... 114/312, 313, 341, 342; 441/1, 32
See application file for complete search history.

(56) References Cited

U.S. PATENT DOCUMENTS

| | | | | |
|---|---|---|---|---|
| 4,048,686 | A * | 9/1977 | Ege | F16L 1/163 114/333 |
| 5,117,775 | A | 6/1992 | Northam et al. | |
| 6,315,626 | B2 | 11/2001 | Jochmann et al. | |
| 7,214,114 | B2 | 5/2007 | Gibson | |
| 7,254,093 | B2 | 8/2007 | Ray et al. | |
| 7,841,917 | B2 | 11/2010 | Pritchard | |
| 8,298,656 | B2 * | 10/2012 | Schneider | B29C 70/887 428/458 |
| 8,333,295 | B1 | 12/2012 | Parker et al. | |
| 9,314,996 | B1 | 4/2016 | Wedding et al. | |
| 9,625,361 | B1 * | 4/2017 | Vail, III | G01N 3/08 |
| 10,167,061 | B2 | 1/2019 | Bregonzio et al. | |
| 10,455,894 | B2 | 10/2019 | Cross et al. | |
| 10,486,851 | B2 | 11/2019 | Takahashi | |
| 10,611,100 | B2 | 4/2020 | Wu et al. | |
| 2008/0254274 | A1 * | 10/2008 | Schneider | C08J 5/249 428/292.1 |
| 2010/0171312 | A1 * | 7/2010 | Burns | B63B 22/00 441/29 |
| 2011/0300358 | A1 * | 12/2011 | Blohowiak | C08J 5/042 148/516 |

OTHER PUBLICATIONS

Frederick Vath and William Colletti, "Development of Buoyancy Material for the Deep Submergence Search Vehicle Evaluation of Sympathetic Implosion of Buoyancy Modules," Defense Technical Information Center (DTIC), AD834133, Progress Report No. 2, Naval Applied Science Lab, Brooklyn, New York, available online at https://apps.dtic.mil/sti/citations/AD0834133, report date Jun. 7, 1968, approved for public release Mar. 26, 1969 (24 pages).

Bo Jiang et al., "Ceramic Spheres—A Novel Solution to Deep Sea Buoyancy Modules," Materials 2016, vol. 9, p. 529, published Jun. 29, 2016, http://www.mdpi.com/journal/materials (13 pages).

"Shape-memory alloy," Wikipedia, retrieved from https://en.wikipedia.org/w/index.php?title=Shape-memory_alloy&oldid=968403793, webpage last edited on Jul. 19, 2020 (15 pages).

"Auxetics," Wikipedia, retrieved from https://en.wikipedia.org/w/index.php?title=Auxetics&oldid=964834197, webpage last edited on Jun. 27, 2020 (6 pages).

"Variable buoyancy pressure vessel," Wikipedia, retrieved from https://en.wikipedia.org/w/index.php?title=Variable_buoyancy_pressure_vessel&oldid=1074131310, webpage last edited on Feb. 26, 2022 (5 pages).

* cited by examiner

I.

II.

III.

IV.
V.

I.

II.

III.

IV.

V.

IMPLOSION-RESISTANT LIGHTWEIGHT MEMBRANE SHELL DEVICES FOR HIGH-PRESSURE APPLICATIONS

CROSS-REFERENCE TO RELATED APPLICATIONS

This patent application claims the benefit of U.S. provisional patent application No. 63/167,527, filed 29 Mar. 2021, hereby incorporated herein by reference, entitled "Implosion-Resistant Lightweight Membrane Shell Devices For High-Pressure Applications," sole inventor Philip J. Dudt.

STATEMENT OF GOVERNMENT INTEREST

The inventorship of the invention described herein includes at least one person who invented the invention in performance of the person's official duties as an employee of the United States Department of the Navy. The invention may be manufactured, used, and licensed by or for the Government of the United States of America for governmental purposes without payment of any royalties thereon or therefor. The Government of the United States of America has ownership rights in the invention.

BACKGROUND OF THE INVENTION

The present invention relates to buoyancy of vessels designed for underwater operation at non-shallow depths, more particularly to methods and apparatuses for supplementing buoyancies of such vessels.

Some underwater vehicles and underwater sensing devices operate at great ocean depths and hence require association therewith of supplementary buoyancy devices in order to account for factors such as hull weight (e.g., heavy hull), hull thickness (e.g., thick hull), batteries, propulsion, fairings, trim tanks, etc. It is generally known that auxiliary buoyancy influence or control can be provided for a vessel by using high-pressure-resistant buoyancy modules characterized by a low weight-to-displacement ratio. For instance, a conventional buoyancy module may include a glass or composite spherical shell or a syntactic foam that incorporates smaller hollow microspheres or somewhat larger macrospheres in a polymer matrix.

However, some current designs of buoyancy modules may incur difficulties insofar as implementations at greater depths typically require relatively thick supporting shells. A thick shell will usually exhibit highest stresses on its internal surfaces, and these stresses create vulnerabilities to fatigue. When a shell is made of a less ductile material such as glass, ceramics, or composites, this can result in premature fracture. When syntactic foams are used, collapsed volumes can fail creating a cascading sympathetic failure that can impact the safety of the host vehicle. In addition, an implosion from a sympathetic failure and localized implosions can result in a pressure wave at depth that can overload surrounding hull pressure structure and lead to additional damage.

SUMMARY OF THE INVENTION

In view of the foregoing, an object of the present invention is to provide better methods and devices for supplementing buoyancies of underwater vessels when operating at greater depths.

According to exemplary inventive practice, an inventive buoyancy device includes a membrane shell and a tangle of shape memory alloy fibers. The membrane shell describes a closed three-dimensional geometric figure, and has an inner surface, an outer surface, and an interior space bounded by the inner surface. Situate in the interior space, the tangle of shape memory alloy fibers exerts an outward pressure upon the inner surface of the membrane shell, and also serves to structurally reinforce the membrane shell. The outward pressure is associated with a shape memory effect characterizing the tangle of shape memory alloy fibers. The outward pressure exerted by the tangle of shape memory alloy fibers attributes the membrane shell with a degree of resistance to inward pressure exerted by a fluid (e.g., water) environment upon the outer surface of the membrane shell. Some inventive embodiments include a core at least substantially composed of an auxetic material, wherein the tangle at least substantially covers the core. The core exerts an outward force associated with a negative Poisson's ratio effect characterizing the core. The outward pressure exerted by the tangle and the outward force exerted by the core, in combination, attribute the membrane shell with a degree of resistance to the inward pressure.

According to some inventive embodiments, an inventive buoyancy device includes a toroidal membrane shell and a toroidal entanglement of fibers, which includes shape memory alloy fibers and magnetic fibers. The toroidal entanglement of fibers has certain qualities that have been imbued while inside the toroidal membrane shell, including shape memory of the shape memory alloy fibers via application of heat, and repositioning (e.g., alignment) of the magnetic fibers via application of an external magnetic field. The toroidal entanglement exerts an outward pressure upon the inner surface of the toroidal membrane shell, the outward pressure associated with the shape memory of the shape memory alloy fibers and with the repositioning of the magnetic fibers.

The present invention, as exemplarily and variously practiced, provides a low weight-to-displacement buoyancy device (e.g., a buoyancy sphere or a buoyancy module) that includes a relatively thin membrane shell, and that is attributed with superior strength and high resistance to sympathetic implosion in a high pressure environment. The present invention further provides methods for producing various embodiments of inventive buoyancy devices. According to multifarious embodiments of the present invention, a membrane shell may be characterized by a closed hollow three-dimensional geometric shape such as spherical, non-spherical ellipsoid, torus, non-circular toroid, or another shape.

Featured by exemplary inventive practice is, inter alia, the inventive implementation of shape memory alloys. Depending upon the inventive embodiment, the shape memory fibers that are inventively implemented may be for example macroscopic filaments, macroscopic wires, nano-filaments, nanowires, or some combination thereof. Depending on the inventive embodiment, the shape memory alloy fibers may vary in terms of material, number, size, shape, configuration, and/or other respects; for instance, in a given inventive embodiment, an inventive "tangle" of shape memory alloy fibers may vary in any or all such respects. Generally speaking, a "shape memory alloy" is an alloy that can be austenitized at a higher temperature in a particular configuration, and then deformed into a complex shape in a martensitic phase. When the complex shape of a shape memory alloy is heated, it returns to its original "memorized" form. A return force is exerted by the shape memory alloy when it returns from its deformed shape to its original shape. The present invention, as exemplarily embodied, avails itself of this return force in order to generate internal forces to counter the external pressure against a closed envelope, e.g., a membrane shell. Examples of shape memory alloy materials that may be suitable for inventive practice include but are not limited to: copper-aluminium-nickel alloys; nickel-titanium alloys; nickel-titanium-copper alloys; and other alloys such as including zinc, copper, gold, and/or iron.

According to exemplary inventive embodiments, the closed envelope is a membrane shell. Exemplary inventive practice provides for a membrane shell made of at least one organic material (e.g., a synthetic or natural polymer), or at least one inorganic material (e.g., a metal or ceramic), or some combination thereof. As exemplarily embodied, an inventive buoyancy device includes a membrane shell having a thin wall-thickness. The membrane shell is supported by a "tangle" of shape memory alloy fibers (e.g., wires or filaments), such as an amorphously intertwined mass of such fibers. For instance, according to exemplary inventive practice, a tangle of shape memory alloy fibers may be characterized by a multiplicity of small, fibrous, shape memory alloy entities intermingled and interspersed in a state of random disarray. In addition to affording support for the membrane shell, the tangle of shape memory alloy fibers affords internal pressure to resist external hydrostatic pressure. According to exemplary inventive practice, the outward force exerted by the fibrous tangle inside the membrane shell provides a counterforce or counter-pressure to high hydrostatic pressure exerted by the water (e.g., sea or ocean) outside the membrane shell. According to exemplary inventive practice, the fibrous tangle is sized and configured to exert an outwardly directed force of significant magnitude. Furthermore, according to exemplary inventive practice, the expanded entanglement of fibers acts as an internal truss support structure. For instance, the internal fibrous entities may act as supporting "struts."

In accordance with exemplary inventive practice, austenitic-phase fibers (e.g., wires or filaments) are compressed in martensitic range to form a tangled mass of shape memory alloy fibers, for instance a complex fibrous mesh body describing a "ball" or another geometry. If failure does occur of an inventively stiffened structure, the harmful effects will likely be limited. Failure of an exemplary inventive buoyancy device will probably involve internal slippage of the supporting struts, but with little tendency to form an abrupt implosion pulse such as would be detrimental to surrounding structures or vehicles.

BRIEF DESCRIPTION OF THE DRAWINGS

The present invention will now be described, by way of example, with reference to the accompanying drawings, wherein:

As shown in FIGS. 1A through ID: (I) A configuration of shape memory alloy fibers is treated in austenitic range (FIG. 1A). (II) The configuration is compressed in martensitic range (FIG. 1B). (III) The configuration is inserted into the form to be strengthened (FIG. 1C). (IV) The form is closed, for example using laser or microwave welding (FIG. 1D). (V) The configuration is re-heated into memory/austenitic range to provide internal pressure and stiffening (FIG. 1D).

As shown in FIGS. 2A through 2E: (I) An auxetic foam core (sphere) is depicted (FIG. 2A). (II) A mesh of crushed martensitic filaments surrounds the foam core (FIG. 2B). (III) The auxetic core and the filaments are placed in a thin spherical shell (FIG. 2C). (IV) The shell seam is completed using microwave or low heat-input laser welding (FIG. 2D). (V) The sphere is heated to austenitic region (FIG. 2E). As shown in FIG. 2E, the filaments attempt to elongate, creating an internal pressure that resists external pressure. The auxetic (negative Poisson's ratio) core provides further resistance to external pressure.

As shown in FIG. 3A, a toroidal insert has shape memory filaments/wires mixed with magnetic nanofibers. FIG. 3B shows a toroidal device, after: (a) insertion of the toroidal insert; and (b) concurrent effectuation of (i) expansion of the shape memory filaments/wires under heating and (ii) positioning of the magnetic nanofibers via external magnetic field. As shown in FIG. 3C, high strength magnetic nanofibers further "entangle" the shape memory alloy support structure at the boundary.

DESCRIPTION OF EXEMPLARY EMBODIMENTS OF THE INVENTION

Referring now to the figures, exemplary practice of the present invention harnesses the shape recovery forces of shape memory alloys to bring to bear (i) an internal pressure "field" and (ii) internal stiffening, doing so with respect to a thin lightweight membrane shell subjected to high hydrostatic pressure. Inventive principles may be effectuated through practice of multifarious inventive variations, including those referred to herein as "first-mode" inventive embodiments, "second-mode" inventive embodiments, and "third-mode" inventive embodiments.

Figure 1A:
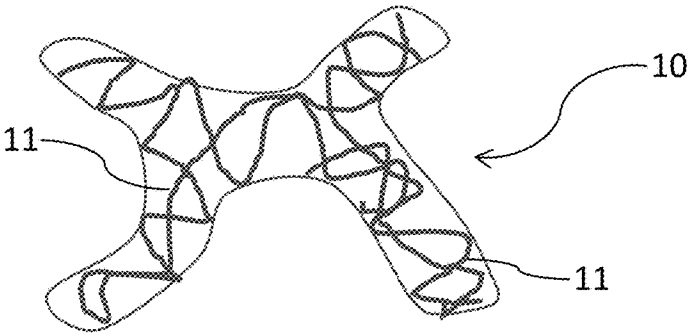
FIGS. 1A, 1B, 1C, and 1D are diagrams illustrating an example of a first mode of practice of a buoyancy device and the making thereof, in accordance with the present invention. An exemplary inventive method of making an inventive buoyancy device according to the first mode includes selective stiffening, via at least one tangle of a plurality of shape memory alloy fibers, of an ellipsoidal geometric form such as a prolate spheroid (for instance as shown in FIG. 1D), an oblate spheroid, or a sphere. Other non-spherical (e.g., ovalesque) geometric forms are also possible in inventive first-mode practice.

With reference to FIGS. 1A through ID, according to exemplary first-mode inventive practice a tangle 10 of shape memory alloy fibers (e.g., wires or filaments) 11 is implemented by itself in association with a membrane shell 20, such as an ellipsoidal (e.g., prolate spheroidal) membrane shell. An entangled homogenous fibrous body is produced by mixing shape memory alloy fibers in intertwining fashion. The tangle 10 of shape memory alloy fibers 11 may be constituted, for example, by loose wires (e.g., wires or nanowires) or discontinuous filaments (e.g., filaments or nano-filaments) or other fibrous shape memory alloy material suitable for inventive practice. The tangle 10 thus formed represents a "truss" for stiffening the ellipsoidal membrane shell at its weakest point(s). The loose-wire truss or discontinuous-filament truss can be heated above the austenitic transition temperature to stabilize it, or can be further downsized by more compression. The size of the initiating truss should be somewhat greater than the diameter of the ellipsoidal shell to provide an internal pressure as well as a natural system of stabilizing struts.

Figure 1B:
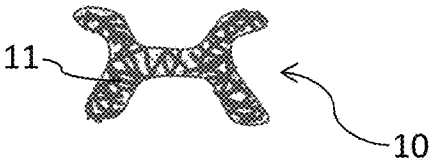
Figure 1C:
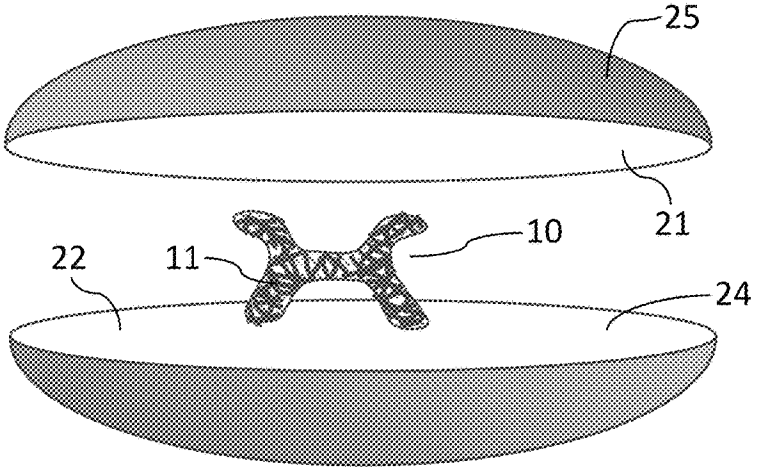
Figure 1D:
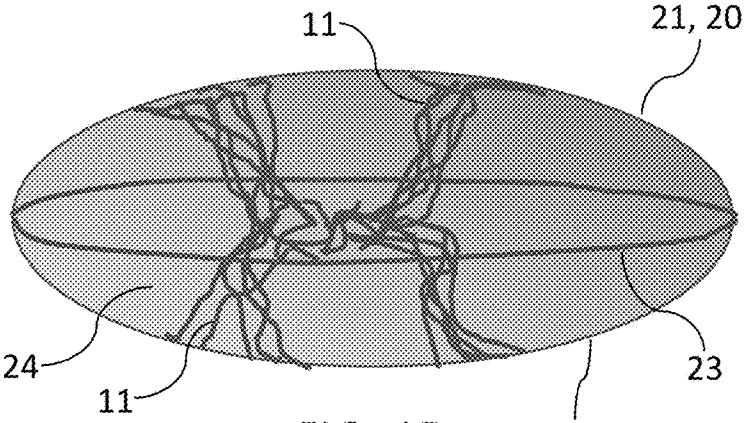

As illustrated by way of example in FIGS. 1A through ID, localized support is inventively provided to the ellipsoidal volume 20 by means of lower levels of out-of-roundness of the shape memory alloy fibrous material form 10. The exemplary inventive method includes: treating an irregular curved mesh 10 of shape memory alloy wires/filaments 11 in austenitic range (FIG. 1A); compressing the irregular curved mesh 10 of shape memory alloy wires/filaments 11 in martensitic range (FIG. 1B); inserting the compressed mesh configuration 10 into halves 21 and 22 of the ellipsoidal object 20 (FIG. 1C); joining the separate half-sections 21 and 22 of the ellipsoidal shell 20, and sealing the circumferential juncture 23 therebetween by low-heat input laser or microwave welding, thereby forming the integral ellipsoidal shell 20 (FIG. 1D), wherein the shape memory alloy composition tangle 10 is situate in the interior space 29 of the integral ellipsoidal shell 20; and heating the shape memory alloy composition tangle 10 into the recovery memory region to supply internal pressure and an internal stiffening system, with respect to ellipsoidal shell 20 (FIG. 1D), wherein shape memory alloy tangle 10 exerts outward pressure against the interior surface 24 of the shell 20. Depending on the inventive embodiment, the outward pressure exerted by the shape memory alloy tangle against the shell's interior surface constitutes pressure against one or more portions of the interior surface, or pressure against at least substantially the entire interior surface.

Referring to FIGS. 2A through 2E, according to exemplary second-mode inventive practice a tangle 10 of shape memory alloy fibers 11 is implemented in combination with an entity made of a different material (e.g., an auxetic foam material). Tangle 10 is an entangled homogenous fibrous body produced by mixing shape memory alloy fibers 11 in intertwining fashion. The tangle 10 of shape memory alloy fibers 11 and the non-shape-memory-alloy entity, such as an auxetic foam body 30, are implemented together in association with a membrane shell 20, such as a spherical membrane shell or other ellipsoidal membrane shell. In general, auxetic materials exhibit a negative Poisson's ratio, and thus thicken/expand in a direction perpendicular to an applied tensile/stretching force. The core 30 contains regions or volumes of auxetic foam that promote resistance to external compression of the enclosing membrane sphere. According to exemplary second-mode inventive practice, the auxetic core material tends to push back (expand) against the force exerted by external pressure, providing another pressure resistance mechanism in conjunction with the memory alloy "struts." These inventive features are in furtherance of the present invention's ability to provide a lighter, more buoyant design. As illustrated by way of example in FIGS. 2A through 2E, the shape of interest is a sphere.

Figure 2A:
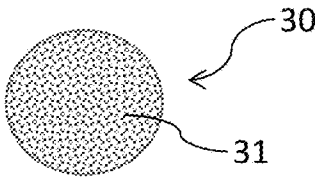
FIGS. 2A, 2B, 2C, 2D, and 2E are diagrams illustrating an example of a second mode of practice of a buoyancy device and the making thereof, in accordance with the present invention. An exemplary inventive second-mode buoyancy device includes an internal core of negative Poisson's-ratio auxetic material, in addition to a tangle of shape memory alloy fibers. An exemplary inventive method of making an inventive buoyancy device according to the second mode includes internal pressurization, via at least one tangle of fibers along with a foam core, of a geometric form such as a sphere (for instance as shown in FIGS. 2D and 2E). Non-spherical ellipsoidal forms are also possible in inventive second-mode practice.
Figure 2B:
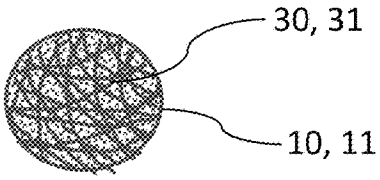
Figure 2C:
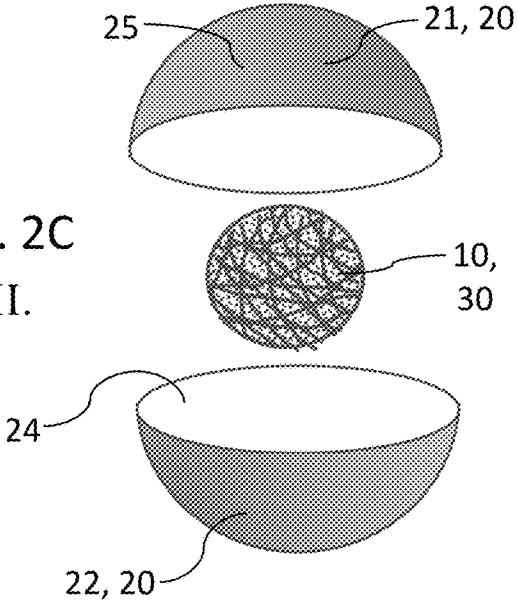
Figure 2D:
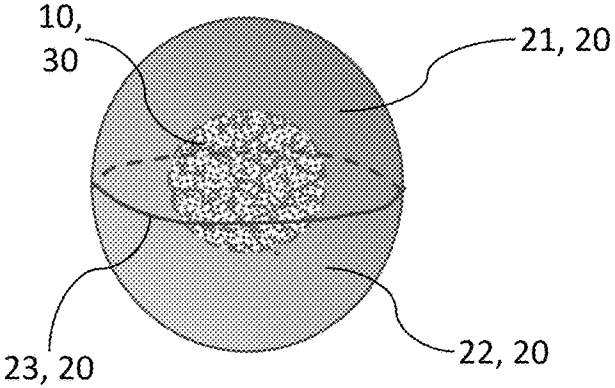

As an example according to inventive second-mode practice, a tangle 10 of shape memory alloy fibers 11 is wound around a core 30 composed of an auxetic foam 31. Tangle 10 thus represents a shape memory alloy mesh covering of core 30. The auxetic material is characterized by a negative Poisson's Ratio. For instance, according to some inventive embodiments the auxetic material is an auxetic polyurethane foam. In the light of the instant disclosure, the ordinarily skilled artisan will appreciate the kinds of auxetic materials that may be suitable for inventive practice. In this example of inventive practice, the core 30 is shown in FIG. 2A to be spherical, and the membrane shell 20 is shown in FIG. 2D to be spherical with a larger diameter. As depicted in FIG. 2B, the shape memory fibers 11 (e.g., macroscopic filaments, macroscopic wires, nano-filaments, or nanowires) are wrapped around the spherical central core 30. The combination of the auxetic foam sphere 30 and the shape memory fiber tangle 10, wrapped therearound, is placed in the interior space 29 of a spherical membrane shell 20. As shown in FIGS. 2C and 2D, to facilitate this placement inside spherical shell 20, the two hemispheres 21 and 22 of shell 20 are at first separated, and are then joined at the respective circumferential edges with the shape memory fiber-wrapped spherical core 30 inside, thereby forming an integral spherical shell 20 having a circumferential junctional seam 23.

Figure 2E:
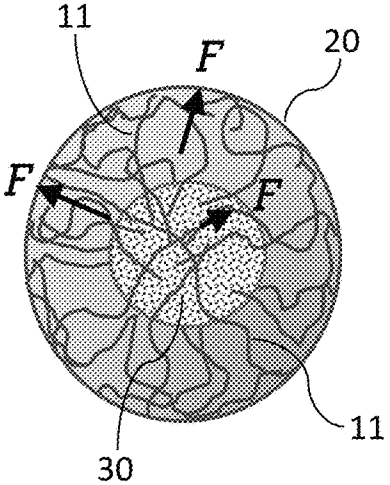

With reference to FIG. 2E, the combination of core 30 and wraparound shape memory fibers 11 is situate inside spherical shell 20, in interior shell space 29, and is heated to austenitic range. Together, the spherical foam core 30 and the shape memory fibers 11 create an internally stiffening "cloud" force inside the spherical membrane shell 20. The shape memory fibers 11 tend to elongate when heated, thereby exerting outward pressure against interior surface 24, from the interior 29 of the spherical shell 20. Depending on the inventive embodiment, the outward pressure exerted by the shape memory alloy tangle against the shell's interior surface constitutes pressure against one or more portions of the interior surface, or pressure against at least substantially the entire interior surface. At the same time, the auxetic foam core 30 expands under compression to provide further internal support to the inventive device configuration. Accordingly, a "truss" is formed by the shape memory fibers 11 around the auxetic foam core 30, which expands under pressure and can thus contribute further to an internal stabilizing pressure. A "cloud" of internal support is thereby created, independently and cooperatively, by the shape memory alloy fibers 11 and the foam core 30, intersecting and supporting one another.

Figure 3B:
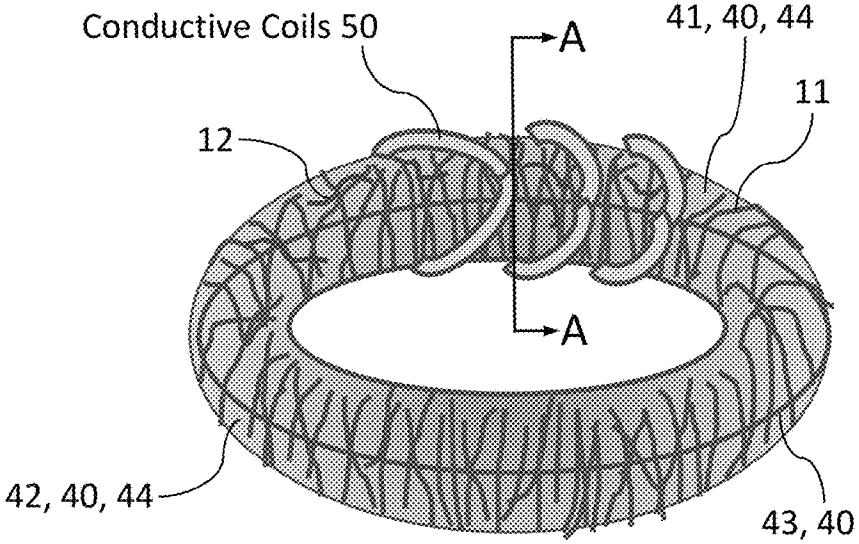
FIGS. 3A, 3B, and 3C are diagrams illustrating an example of a third mode of practice of a buoyancy device and the making thereof, in accordance with the present invention. An exemplary inventive method of making an inventive buoyancy device according to the third mode includes internal pressurization, via at least one tangle of a plurality (e.g., multiplicity) of fibers that includes shape memory alloy fibers (e.g., wires or filaments) and magnetic nanofibers (e.g., nanowires or nano-filaments), of a geometric form such as a toroid. Magnetic fibers are included in the "tangling," along with shape memory alloy fibers. For instance, the torroid shown in FIGS. 3A, 3B, and 3C is a torus, i.e., a circular toroid, which is kind of toroid generated by a circle revolving around an axis. Noncircular toroids—i.e., toroids generated by revolving noncircular shapes (e.g., ovals, ellipses, rectangles, or other closed-curve or polygonal shapes)—are also possible in inventive third-mode practice.
Figure 3A:
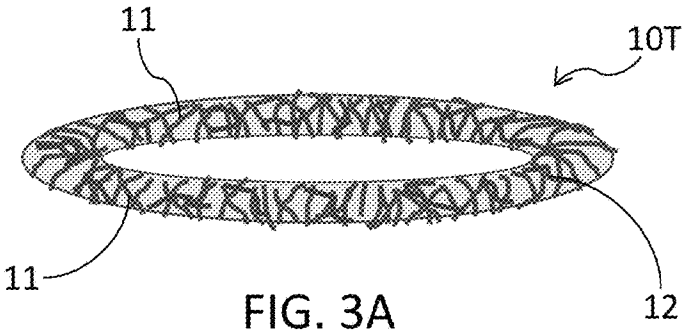
Figure 3C:
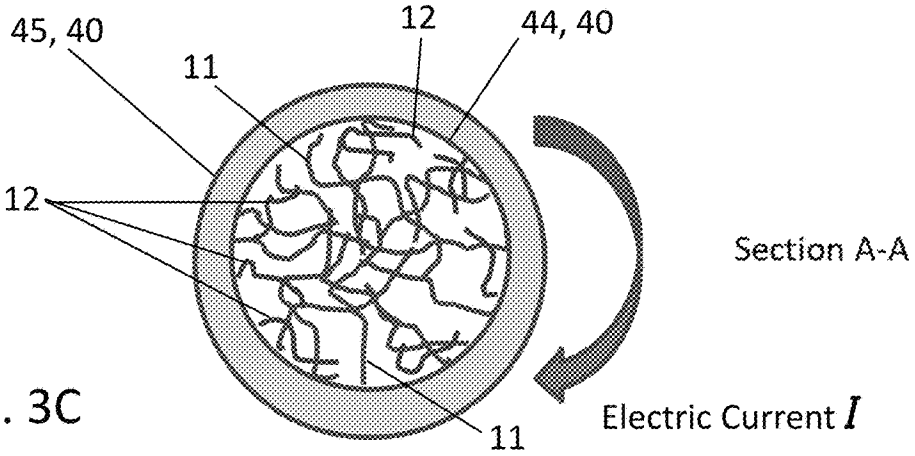

Reference is now made to FIGS. 3A through 3C, which are exemplarily illustrative of third-mode inventive practice. Featured by third-mode inventive practice is, inter alia, a utilization of an entangled heterogeneous fibrous body that has been produced by mixing shape memory alloy fibers and magnetic fibers in intertwining fashion. The exemplary inventive buoyancy device shown in FIGS. 3A through 3C is characterized by a toroidal membrane shell 40. More specifically, the inventive device shown in FIGS. 3A through 3C includes a membrane shell 40 having a torus geometric shape. Third-mode inventive practice may be considered for various purposes, such as for stiffening of underwater vessels, or for tankage. For instance, an inventive embodiment may be designed whereby the toroidal shell 40 is capable of holding liquids.

According to third-mode inventive practice such as exemplarily shown in FIGS. 3A through 3C, a heterogeneous tangle 10T of a plurality of shape memory alloy fibers (e.g., wires or filaments) 11 and a plurality of magnetic fibers (e.g., magnetic nanofibers or magnetic filaments) 12 is implemented in association with a toroidal membrane shell 40, similarly as a homogeneous tangle 10 of a plurality of shape memory alloy fibers (e.g., wires or filaments) 11 is implemented in association with an ellipsoidal membrane shell 20 such as exemplarily shown in FIGS. 1A through 1E. FIGS. 3A through 3E illustrate, by way of example, implementation of a heterogeneous tangle 10T of fibers—viz., shape memory alloy fibers 11 in combination with magnetic fibers 12—inside a toroidal membrane shell 40. The tangle 10T of fibers situate inside toroidal membrane shell 40 includes not only shape memory alloy fibers 11 but also magnetic fibers 12. Note that, as distinguished from FIGS. 3A through 3C, FIGS. 1A through 1E show implementation of a homogeneous tangle 10 of shape memory alloy fibers 11—viz., shape memory alloy fibers 11 alone—inside an ellipsoidal membrane shell. A tangle that is described herein as "homogeneous" has fibers of only one type, e.g., shape memory alloy fibers 11. A tangle that is described herein as "heterogeneous" has fibers of at least two types, e.g., shape memory alloy fibers 11 and magnetic fibers 12. Depending on the inventive embodiment, either or both of the shape memory alloy fibers and magnetic fibers may vary in terms of material, number, size, shape, configuration, and/or other respects; for instance, in a given inventive embodiment, the combined inventive entanglement of the shape memory alloy fibers and the magnetic fibers vary in any or all such respects.

The heterogeneously mixed tangle 10T of fibers (which combines shape memory alloy fibers 11 and magnetic fibers 12) is shown by itself in FIG. 3A. Tangle 10T has a toroidal shape that approximately matches the toroidal shape of membrane shell 40. Toroid shell 40 has two shell half-sections 41 and 42. Tangle 10T is placed in half-section 41, and the two half-sections 41 and 42 are then joined to form an integral toroid shell 40 having a circumferential seam 43, a shell interior surface 44, a shell exterior surface 45, and a shell interior space 49. As depicted in FIG. 3B, the toroid shell 40 is wrapped with electrically conducting coils 50 on the external surface of the toroid shell 40. Two stimuli—viz., (i) heating and (ii) an external magnetic field—are applied (e.g., simultaneously applied) to the heterogeneous tangle 10T while situate inside the toroid shell 40, in the shell interior space 49. The heating causes the shape memory alloy fibers 11 in tangle 10T to expand. Depending on the inventive embodiment, the outward pressure exerted by the shape memory alloy tangle against the shell's interior surface constitutes pressure against one or more portions of the interior surface, or pressure against at least substantially the entire interior surface. Current I, received from a dc or ac power supply (not shown), is conducted by coils 50 resulting in a magnetic field that causes the magnetic fibers 12 to be positioned (e.g., aligned) so as to enhance the entanglement of the fibrous mass 10T, thereby bringing greater pressure to bear on the interior surface 44 of toroidal shell 40, such as shown in FIG. 3A. Thus utilized in conjunction with the shape memory alloy fibers 11, the magnetic fibers 12 lend further support to the inventive device configuration. The high strength magnetic fibers 12 serve, inter alia, to further entangle the shape memory alloy fibers 11, particularly in locations contiguous to or in the vicinity of the hollow interior surface of the toroidal membrane shell 40. If an inventive buoyancy device of this kind were to fail by slippage, the complex internal stiffening arrangement would militate against catastrophic collapse, generation of sympathetic implosion, and generation of destructive pressure pulses.

The present invention's methodology features, inter alia, the application of the return force of a shape memory alloy to a thin wall membrane shell so as to afford internal pressurization and reinforcement of the thin wall membrane shell, thereby enabling the thin wall membrane shell to resist high hydrostatic pressure. Inventive application of the return force of a shape memory alloy permits inventive implementation of a membrane shell characterized by a thinner wall, as distinguished from conventional practice implementing a shell characterized by a thicker wall. A buoyancy design providing for a thicker shell wall, such as found in conventional practice, will usually result in a heavier device attributed with relatively little capability for mitigating pressure pulses from implosion. In contrast to thicker-wall shells, the present invention's thinner-wall shells will often be capable of being pressed from sheet material after annealing, and will generally carry lower costs. Thin membrane shells such as may be suitable for implementation in exemplary inventive practice do not evidence significant through-thickness stress gradients, which can increase vulnerability to fracture and fatigue.

As discussed hereinabove, the present invention may be practiced as having any of a variety of inventive features. For instance, an inventive tangle of fibers may be employed so as to selectively strengthen critical portions of a membrane shell. An inventive buoyancy device may be embodied so that the tangled complex of fibers is inclusive of one or more additional fiber types, which are intertwined with the shape memory fibers. If an inventive tangle of fibers includes an additional fiber type that is magnetic, then positioning (e.g., alignment) of the magnetic fibers can be carried out using coils or other magnetic means. The tangle of fibers (such as including shape memory alloy fibers) can be combined with an additional reinforcement (such as an auxetic foam) to add further internal strengthening. Exemplary practice of the present invention offers ample flexibility in design and construction of inventive buoyancy apparatuses, as well as a considerable capability of minimizing pressure spikes from implosion. Inventive practice is possible with respect to membrane shells having any of a variety of closed three-dimensional shapes. Exemplary inventive practice provides for membrane shell shapes that are "rounded," i.e., to at least some degree characterized by curvature. Inventive practice is possible wherein both an auxetic foam material and a fibrous magnetic material is implemented, in addition to a fibrous shape memory alloy material. For instance, a toroidal auxetic foam core may be used in a manner combining elements of inventive second-mode practice and inventive third-mode practice, wherein a heterogeneously intertwined fibrous entity composed of shape memory alloy fibers and magnetic fibers is wrapped around a toroidal auxetic foam core.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. A buoyancy device comprising:

a membrane shell describing a closed three-dimensional geometric figure, said membrane shell having an inner surface, an outer surface, and an interior space bounded by said inner surface;

a tangle of shape memory alloy fibers, said tangle characterized by a shape memory and situated in said interior space, wherein said tangle exerts a return force to return said tangle to a memorized shape, said tangle thereby exerting an outward pressure upon said inner surface of said membrane shell.

2. The buoyancy device of claim 1, wherein said tangle reinforces said membrane shell.

3. The buoyancy device of claim 1, wherein a fluid environment exerts an inward pressure upon said outer surface of said membrane shell, and wherein said outward pressure exerted by said tangle attributes said membrane shell with a degree of resistance to said inward pressure.

4. The buoyancy device of claim 1, wherein said tangle is in a heated condition to achieve a shape memory state of said tangle.

5. The buoyancy device of claim 4, wherein a fluid environment exerts an inward pressure upon said outer surface of said membrane shell, and wherein said outward pressure attributes said membrane shell with a degree of resistance to said inward pressure.

6. The buoyancy device of claim 1, further comprising a core at least substantially composed of an auxetic material, wherein said tangle at least substantially covers said core.

7. The buoyancy device of claim 6, wherein the combination including said tangle and said core reinforces said membrane shell.

8. The buoyancy device of claim 6, wherein:

a fluid environment exerts an inward pressure upon said outer surface of said membrane shell;

said core exerts an outward force in accordance with a negative Poisson's ratio characterizing said core;

said outward pressure exerted by said tangle and said outward force exerted by said core, in combination, attribute said membrane shell with a degree of resistance to said inward pressure.

9. The buoyancy device of claim 8, wherein:

said tangle is wrapped about said core, thereby producing a tangle-wrapped core that includes said tangle and said core;

said tangle-wrapped core is situated in said interior space;

said tangle included in said tangle-wrapped core is in a heated condition to achieve a shape memory state of said tangle.

10. The buoyancy device of claim 9, wherein said membrane shell includes two half-sections of said membrane shell, said two half-sections being separable for facilitating placement of said tangle-wrapped core in a said half-section, said two half-sections being joinable for forming said membrane shell.

11. The buoyancy device of claim 9, wherein:

a fluid environment exerts an inward pressure upon said outer surface of said membrane shell;

said core exerts an outward force in accordance with a negative Poisson's ratio characterizing said core;

said outward pressure exerted by said tangle and said outward force exerted by said core, in combination, attribute said membrane shell with a degree of resistance to said inward pressure.

12. The buoyancy device of claim 1, wherein said closed hollow three-dimensional geometric figure is selected from the group consisting of spherical, non-spherical ellipsoid, torus, and non-circular toroid.

13. A buoyancy device comprising:

a toroidal membrane shell having an inner surface, an outer surface, and an interior space bounded by said inner surface;

a toroidal entanglement of fibers including shape memory alloy fibers and magnetic fibers, said toroidal entanglement situated in said interior space of said toroidal membrane shell, said toroidal entanglement characterized by shape memory of said shape memory alloy fibers and by repositioning of said magnetic fibers, said shape memory of said shape memory alloy fibers exerting a return force to return said shape memory alloy fibers to a memorized shape, said shape memory of said shape memory alloy fibers resulting from subjection of said toroidal entanglement to heating, said repositioning of said magnetic fibers resulting from subjection of said toroidal entanglement to an external magnetic field;

wherein, in accordance with said shape memory of said shape memory alloy fibers, and further in accordance with said repositioning of said magnetic fibers, said toroidal entanglement exerts an outward pressure upon said inner surface of said toroidal membrane shell.

14. The buoyancy device of claim 13, wherein said toroidal entanglement reinforces said toroidal membrane shell.

15. The buoyancy device of claim 13, wherein a fluid environment exerts an inward pressure upon said outer surface of said toroidal membrane shell, and wherein said outward pressure exerted by said toroidal entanglement attributes said membrane shell with a degree of resistance to said inward pressure.

16. The buoyancy device of claim 13, wherein said shape memory of said shape memory alloy fibers results from said subjection of said toroidal entanglement to heating while said toroidal entanglement is situated in said interior space of said toroidal membrane shell, and wherein said repositioning of said magnetic fibers results from said subjection of said toroidal entanglement to an external magnetic field while said toroidal entanglement is situated in said interior space of said toroidal membrane shell.

17. A method for making a buoyancy device, the method comprising:

placing a fibrous tangle inside a membrane shell, said membrane shell describing a closed three-dimensional geometric figure and having an inner surface, an outer surface, and an interior space bounded by said inner surface, said fibrous tangle being a tangle of a plurality of shape memory alloy fibers;

applying heat to said fibrous tangle placed in said interior space, said applying of said heat being performed so as to imbue said fibrous tangle with an austenitic shape memory, wherein said fibrous tangle thus imbued exerts an outward pressure upon said inner surface of said membrane shell.

18. The method for making a buoyancy device as recited in claim 17, wherein said placing of said fibrous tangle inside said membrane shell includes providing two half-sections of said membrane shell, placing said fibrous tangle in a said half-section, and joining said two half-sections to form said membrane shell.

19. The method for making a buoyancy device as recited in claim 17, wherein:

said outward pressure exerted by said fibrous tangle attributes said membrane shell with a degree of resistance to an inward pressure exerted by a fluid environment upon said outer surface of said membrane shell;

said placing of said fibrous tangle and said applying of said heat are performed so that said tangle is configured to attribute said membrane shell with said resistance to said inward pressure.

20. The method for making a buoyancy device as recited in claim 17, further comprising:

combining said fibrous tangle with an auxetic foam core, said combining including wrapping said fibrous tangle around said auxetic foam core;

placing said auxetic foam core in said interior space;

wherein said fibrous tangle and said auxetic foam core are placed, thus combined, in said interior space.

21. The method for making a buoyancy device as recited in claim 17, wherein:

said geometric figure is a toroid;

said fibrous tangle further includes a plurality of magnetic fibers;

the method further comprises applying an external magnetic field to said fibrous tangle placed in said interior space, thereby repositioning said magnetic fibers in said fibrous tangle.

* * * * *